US006055907A

United States Patent [19]

Endisch et al.

[11] Patent Number: 6,055,907

[45] Date of Patent: May 2, 2000

[54] PROCESS FOR ATTAINING A PRODUCTION-RUN STATE IN A WEB-FED ROTARY PRINTING MACHINE

[75] Inventors: Martin Endisch, Wertingen; Bernhard Feller; Josef Göttling, both of Friedberg, all of Germany

[73] Assignee: MAN Roland Druckmaschinen AG, Offenbach am Main, Germany

[21] Appl. No.: 09/149,850

[22] Filed: Sep. 8, 1998

[30] Foreign Application Priority Data

Sep. 8, 1997 [DE] Germany ..... 197 39 283

[51] Int. Cl.[7] ..... B41F 31/30; B41F 33/08

[52] U.S. Cl. ..... 101/484; 101/352.01; 101/425

[58] Field of Search ..... 101/349.1, 350.1, 101/350.2, 350.4, 351.1, 352.1, 423, 424, 425, 207–210, 363, 483, 484, 485, 148, 217, 177, 247, 143, 144, 145

[56] References Cited

U.S. PATENT DOCUMENTS

| | | | |
|---|---|---|---|
| 4,972,771 | 11/1990 | Wesgerber et al. | 101/148 |
| 5,388,514 | 2/1995 | Eltner | 101/352.01 X |
| 5,471,929 | 12/1995 | Rogge et al. | 101/247 |

FOREIGN PATENT DOCUMENTS

| | | |
|---|---|---|
| 2 341 510 | 4/1974 | Germany . |
| 33 09 557 | 9/1984 | Germany . |
| 44 24 590 | 1/1996 | Germany . |
| 196 15 156 | 4/1996 | Germany . |
| 296 12 159 | 10/1996 | Germany . |
| 60-101048 | 6/1985 | Japan . |
| 63-315244 | 12/1988 | Japan . |
| 4-83643 | 3/1992 | Japan . |
| 62-151343 | 3/1992 | Japan . |
| 9-70950 | 3/1997 | Japan . |

*Primary Examiner*—J. Reed Fisher

*Attorney, Agent, or Firm*—Cohen, Pontani, Lieberman & Pavane

[57] ABSTRACT

A process for a web-fed rotary printing machine and, in particular, a process for pre-inking an inking mechanism. The inking mechanism is cleaned when all other rotating parts of the printing machine are standing still, even with an inserted printing web. Ink residues are removed from the inking mechanism by a washing device, until a defined starting state is reached. The inking mechanism is then newly inked in accordance with subject-specific instructions, i.e., in accordance with a print job to be printed. The inking is performed in parallel fashion during the start-up of the printing machine. Ink application rollers are positioned on a form cylinder when the form cylinder attains a predetermined rotational velocity.

15 Claims, 3 Drawing Sheets

PROCESS FOR ATTAINING A PRODUCTION-RUN STATE IN A WEB-FED ROTARY PRINTING MACHINE

BACKGROUND OF THE INVENTION

1. Field of the Invention

The present invention relates to a process for attaining a production-run state in a web-fed rotary printing machine having a form cylinder and an inking mechanism with inking zones. The inking mechanism has an ink duct box as well as ink transfer rollers and ink application rollers, which ink the form cylinder by zones in accordance with an image to be printed on a printing stock web.

2. Description of the Related Art

In sheet-fed offset printing machines, a process to reduce the number of spoiled sheets at the start of printing is known. Before any paper is printed on, ink application rollers and a wetting agent application roller are positioned on a form cylinder. Without using any paper, it is possible to achieve a desired ink flow from an ink duct box to the surface of the form cylinder as well as a desired supply of wetting agent to the surface of the form cylinder. Water quantity and printing ink quantity are regulated by suitable servocontrol, taking into account a lack of pressure, at the moment. Thus, less water and less printing ink are taken by the form cylinder and from the wetting agent application roller than would be taken during a production run.

In known rotary printing machines, the above process cannot be implemented without further measures, due to the uninterrupted printing stock web, which is transported by means of contact between printing cylinder and the form cylinder (direct printing), or contact between printing cylinder and a transfer cylinder, i.e., a rubber-blanket cylinder (offset printing). Because of the contact of the printing stock web with the form cylinder or the rubber-blanket cylinder, starting and stopping the paper transport is problematic. Disadvantageously the paper web adheres to the form cylinder or rubber-blanket cylinder due to friction, especially as a result of ink residues. Therefore, the paper web is damaged. Furthermore, web tears cannot be ruled out.

In addition, in rotary printing machines that use a wetting agent, it has been found that ink zone blades that rest on the ink duct roller are set to a gap width of 0 upon interruptions in production and at the end of production. The printing ink located on the ink application roller (which has already been moved away from the form cylinder) and the ink transfer rollers, is thereby conveyed back to the ink duct roller by the ink feed roller. The printing ink is consequently emulsified with the wetting agent, and because of enrichment with the wetting agent in the inking mechanism, impurities are fed back to the ink duct box. On the other hand, if, when the ink zone blades are set to a gap width set at 0, an attempt is made to transfer the ink remaining in the inking mechanism from the ink transfer rollers and the ink application roller positioned on the form cylinder to the form cylinder, i.e., to the printing forms located thereon, while at the same time moving the wetting mechanism out of position, an acute danger of a printing web breakage is created.

German reference DE 44 30 693 A1 discloses a rotary offset printing machine in which the form cylinder, the transfer cylinder and the pressure cylinder have separate individual drives and are not in mechanical driving connection with one another. Similarly, the rollers of an inking mechanism or a wetting mechanism can be driven separately from the form cylinder, the transfer cylinder or the pressure cylinder. For example, all ink and wetting agent distribution cylinders of an inking mechanism and a wetting mechanism can have a shared drive with an electric motor. The wetting agent distribution cylinder could also be driven by a separate electric motor, however. Further, German reference DE 44 30 693 A1 discloses a rotary printing machine wherein, each ink and wetting agent distribution cylinder is driven by a separate electric motor.

SUMMARY OF THE INVENTION

The object of the present invention is to provide a process for attaining a production-run state for printing an image on a printing web, in a web-fed rotary printing machine. The printing machine includes an inking mechanism having a drive separate from a form cylinder and/or a transfer cylinder, so that inking of the form cylinder required for a production run is quickly achieved. A further object of the present the invention is to significantly reduce the number of spoilage sheets printed.

The inventive process is related to a web-fed rotary printing machine with a form cylinder and an inking mechanism having ink zones. The inking mechanism includes an ink duct box, an ink duct roller, ink transfer rollers and ink application rollers arranged so as to ink the form cylinder by zones in accordance with the image to be printed.

In a preferred embodiment of the present invention, the process includes the steps of:

(a) driving the ink duct roller, the ink transfer rollers and the ink application rollers, independently of the form cylinder;

(b) inking the ink duct roller, the ink transfer rollers and the ink application rollers with printing ink, in accordance with the image to be printed, either parallel to or independent of a start-up process of the printing machine; and (c) positioning the ink application rollers on the form cylinder when the form cylinder has reached a predetermined speed.

A special advantage of the present invention is that when there is an interruption in the printing process, for example, due to activation of a web break alarm, a defined starting state is achieved by cleaning the inking mechanism. Starting from this state, the ink transfer rollers and the ink application rollers can be re-inked in keeping with subject-matter to be printed, so that, when the printing process is resumed, the same starting state is achieved and only a small number of spoilage pages are printed.

Thus, according to the present invention, the inking mechanism is cleaned by a washing device, so that a reproducible starting state is always attained before the rollers are re-inked so as to achieve a pre-inking of the inking mechanism suitable for the production run. The process according to the present invention produces, on the various inking mechanism rollers, a distribution of an ink layer thickness profile desired for a stationary state during the production run.

The above distribution can be produced by means of a start-up process that occurs parallel to other set-up processes. The layer thickness needed on each of the inking mechanism rollers (also called compensation layer thickness) depends primarily on the design of the inking mechanism. The layer thickness also depends on ink requirements of the given subject-matter and on the particular materials being used in the printing process, such as the printing ink and printing stock. To ensure correct practical application, a parameter table is used that contains measurement values from printing plate scanning, the ink requirements determined from digital data or empirical values from operating personnel. Similarly, empirical values based on the use of similar resources (printing ink, wetting agent, paper) from earlier printing processes can be used again.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

Examples of the invention are described in greater detail below in reference to the drawings, wherein like reference numerals denote similar elements throughout.

DETAILED DESCRIPTION OF THE PREFERRED EMBODIMENTS

Figure 1:
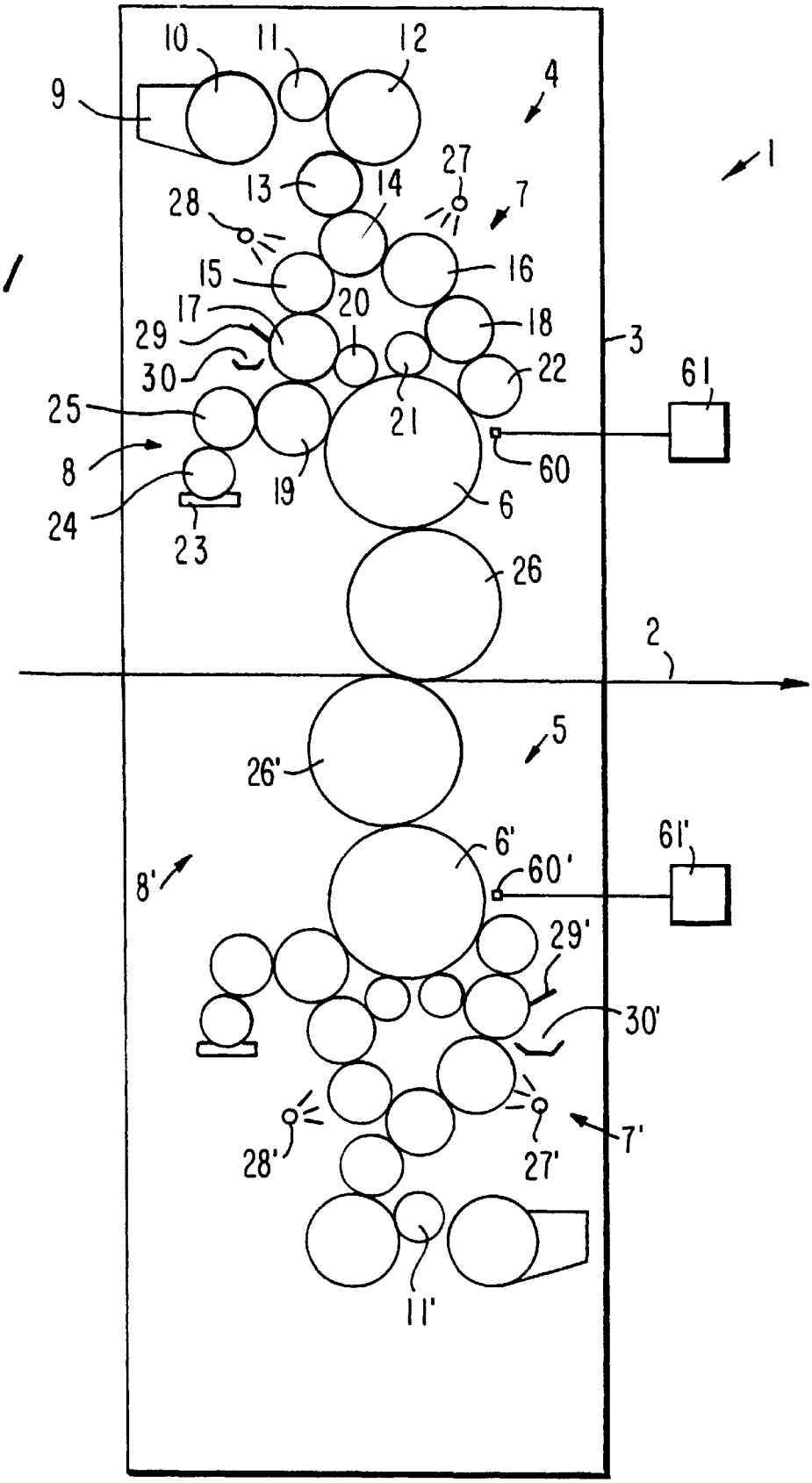
FIG. 1 is a diagram of a printing unit with two printing groups, each having an inking mechanism, for printing a printing stock web.

A web-fed rotary printing machine 1 (FIG. 1), referred to hereinafter as the printing machine 1, serves to print a printing stock web 2, also referred to as the paper web 2. The printing machine 1 has a plurality of printing units, of which for example, only one of the printing units 3 is shown in FIG. 1. Each printing unit 3 has two printing groups 4 and 5. Because the two printing groups 4, 5 are constructed as a mirror image of each other, only the structure of one of the printing groups 4 is described; reference numbers for corresponding elements of the other printing group 5 being marked with an apostrophe (').

The printing group 4 has a form cylinder 6, which carries, on an outer circumferential surface thereof, one or more printing, forms. The form cylinder 6 is supplied with printing ink by means of an inking mechanism 7 and with wetting agent by means of a wetting mechanism 8. The inking mechanism 7 has an ink duct box 9 filled with printing ink, in which an ink duct roller 10 rotates. In accordance with an established gap width (not shown here) of ink zone blades that rest on the outer circumferential surface of the ink duct roller 10, the printing ink is transferred from the ink duct roller 10 to a feed roller 11. The feed roller 11 transfers the printing ink to an inking mechanism roller 12. The printing ink is then transferred by means of ink transfer rollers 13, 14, 15, 16, 17, 18 from the inking mechanism roller 12 to ink application rollers 19, 20, 21 and 22. The ink application rollers 19–22, apply the printing ink to the outer circumferential surface of the form cylinder 6.

The wetting mechanism 8, which has a wetting agent duct box 23, a wetting agent duct roller 24 and a wetting agent distributor 25, transfers the wetting agent to one of the ink application rollers 19 and thus introduces the wetting agent into an ink roller train of the inking mechanism 7. The one ink application roller 19 therefore also functions as a wetting agent application roller.

The rollers 10–22 belonging to the inking mechanism 7, as well as the rollers 24, 25 belonging to the wetting mechanism 8, are driven independently of the form cylinder 6 and of a transfer cylinder 26. The transfer cylinder 26 transfers the printed image from the form cylinder 6 to the printing stock web 2. The ink duct roller 10 as well as the ink transfer rollers 14, 17 and 18 and, in some cases the inking mechanism roller 12, are equipped either with a shared driving motor or alternatively with their own individual driving motors.

In an embodiment of the present invention, in the inking mechanism 7, only the ink duct roller 10 has its own driving motor, which can operate at different adjustable speeds. Preferably, the ink duct roller 10 operates at a low circumferential speed, in accordance with inking requirements, during the printing process. When the printing stock web 2 is standing still, the ink application rollers 19–22 are moved away from the form cylinder 6, the inking mechanism rollers 11 to 22 being driven by the driving motor of the ink duct roller 10. A drive connection (with gearwheels) and a connectable coupling are provided between the ink duct roller 10 and, at least, the ink transfer rollers 14, 17, 18 and, in particular, the inking mechanism roller 12. The wetting mechanism 24 is also equipped with its own drive, being driven independently of the form cylinder 6 and the transfer cylinder 26. The ink application rollers 19 to 22 are moved away from the outer circumferential surface of the form cylinder 6. In addition, the one of the ink application rollers 19 is moved away from the wetting agent distributor 25, while the feed roller 11 is positioned on the inking mechanism roller 12, so that the inking mechanism roller no longer absorbs the printing ink from the ink duct roller 10. The rollers 11–22 of the inking mechanism 7 are cleaned by means of a known cleaning or washing device, without the form cylinder 6 or the transfer cylinder 26 having to be rotated further. The form cylinder 6 and the transfer cylinder 26 have their own separate drives. Alternatively, the form cylinder 6 and the transfer cylinder 26 have a shared drive, being connected to each other by means of gearwheels. Because the inking mechanism rollers 11–22 are driven independently of the form cylinder 6 and the transfer cylinder 26, the inking mechanism 7 is cleanable even when the printing stock web 2 remains inserted in the printing machine 1.

A cleaning device comprises, for example, two spray bars 27, 28, which spray a cleaning agent onto, in particular, the closest inking mechanism rollers 15, 16. The cleaning agent is distributed evenly in the inking mechanism 7 by the rotation of all of the inking mechanism rollers 11–22. By means of a blade 29 positioned on the inking mechanism roller 17 during the cleaning process, the cleaning agent is wiped off, together with the ink residues. The cleaning agent and ink residues are then caught in a catch basin 30. Cleaning devices of the aforementioned type are widely known, for example, from German references DE 33 09 557 A1 and DE 44 24 590 A1. When the inking mechanism 7 is cleaned, a defined starting state with clean inking mechanism rollers 11–22 is established. Subject-specific inking is undertaken, in accordance with the subject-matter to be printed, before the ink application rollers 19–22 are positioned on the form cylinder 6. The subject-specific inking is undertaken as follows: the ink zone blades are positioned in a subject-specific manner on the ink duct roller 10; the feed roller 11 then transfers the printing ink to the inking mechanism roller 12; from which the ink is transferred to the ink application rollers 19–22 not yet positioned on the form cylinder 6. The wetting agent duct roller 24 is then activated so as to supply the one of the ink application rollers 19 with the wetting agent. First, the one ink application roller 19 is positioned on the form cylinder 6, the one ink application roller 19 transferring the wetting agent as well as the ink. The other ink application rollers 20 to 22 are then positioned on the form cylinder 6.

Alternatively, the form cylinder 6 is included in the pre-inking process. In this case, the ink application rollers 19–22 are positioned on the form cylinder 6. The form cylinder 6 is moved away from the transfer cylinder 26 during pre-inking. At a suitable timepoint during the pre-inking process, the wetting agent distribution roller 25 is positioned on the ink application roller 19, so as to enable the wetting agent to reach the form cylinder 6. Advantageously, in this pre-inking process, the wetting agent and the printing ink are supplied in lesser quantity than during a production run, as no printing ink is transferred from the form cylinder 6 to the transfer cylinder 26 and thus to the printing stock web 2.

Figure 2:
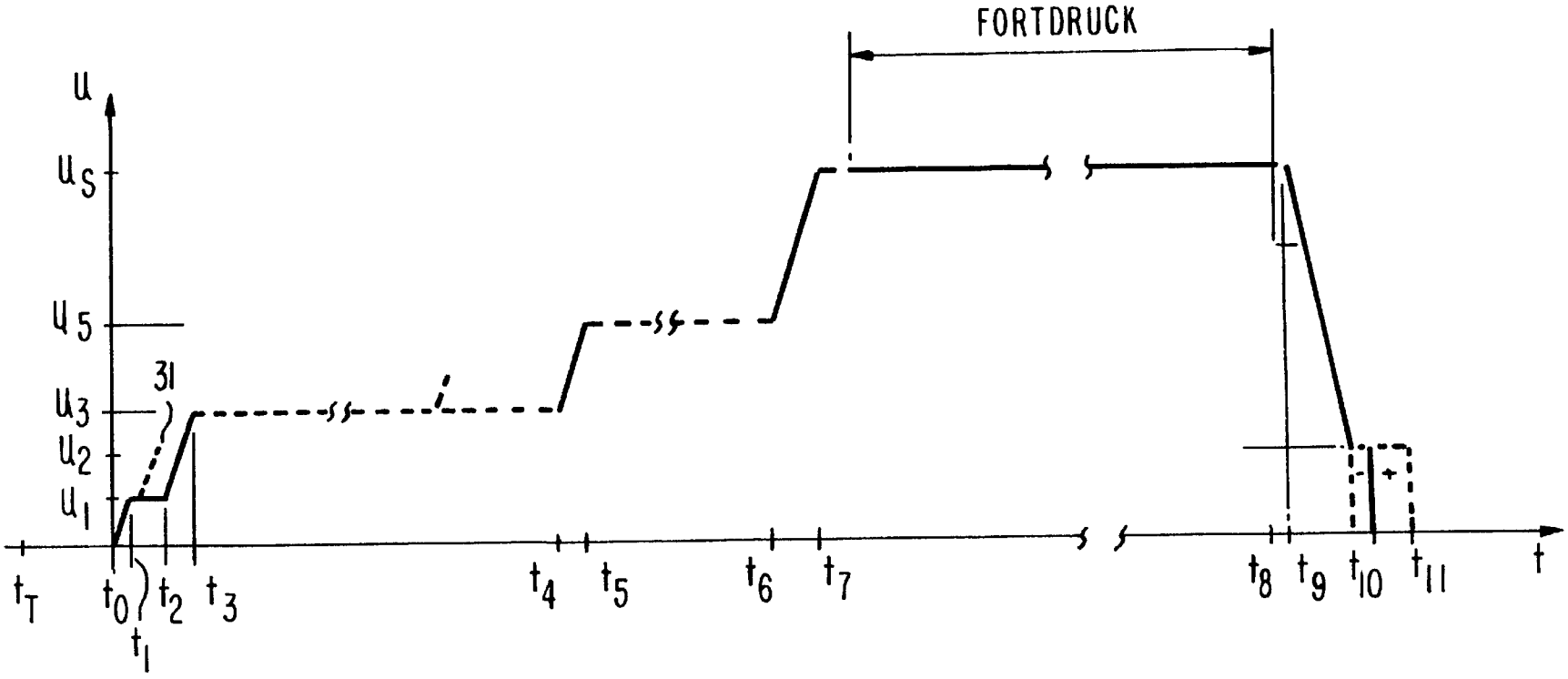
FIG. 2 is a graph showing speed of a rotary printing machine as a function of time.

The printing machine 1 is placed into operation at an initial timepoint $t_0$ (FIG. 2). The transfer cylinders 26, 26' (FIG. 1), and the form cylinders 6, 6' (FIG. 1), are placed into rotation until they reach, at a first timepoint $t_1$, a desired first number of revolutions $U_1$, which corresponds, for example, to ⅛ of a target number of revolutions during printing production. A hot air drier belonging to the printing machine 1 is activated, as soon as the first number of revolutions $U_1$ is reached, so that the drier reaches a predetermined target temperature. A warm-up function of the drier is shown by a line 31. At a second timepoint $t_2$, the printing stock web 2 is accelerated, so as to reach a desired second number of revolutions $U_2$, of for example, 10000/h. The transfer cylinders 19–22 are positioned on the printing stock web 2, provided that the drier target temperature is reached. At a third timepoint $t_3$ and a corresponding third number of revolutions $U_3$, the wetting agent distribution rollers 25, 25' are positioned on the ink application rollers 19, 19'. The ink application rollers 19–22 are then positioned on the form cylinder 6, whereby, as described above, first the one of the ink application rollers 19 and then the other ink application rollers 20–22 are positioned. Correspondingly, the ink application rollers 19'–22' are positioned on the form cylinder 6'.

A prerequisite to positioning the application rollers 19–20, 19'–20' is that at the third timepoint $t_3$, all of the inking mechanisms 7, 7' have an inking profile required for a production run. The inking mechanisms 7, 7' are therefore activated at a start timepoint $t_F$ that is, for example, before the initial timepoint $t_0$, but alteratively could also be between the initial timepoint, $t_0$ and the third timepoint $t_3$. The ink zone blades are set so that the ink profile required for a production run is established on the ink duct roller 10. The feed roller 11 is brought into oscillation, and the drives of the driven inking mechanism rollers 14, 17, 18, as well as of the driven ink duct roller 10, allow the inking mechanism rollers 14, 17, 18 and the ink duct roller 10 to run synchronously with one another.

The ink zone blades are, for example, briefly opened in accordance with the subject-matter to be printed, whereby the ink zone blades are over-controlled. Preferably, those ink zones where little printing ink is needed are over-controlled with a greater deviation from a final filling gap setting than those ink zones where much ink is needed. Information on target gap widths is supplied to the ink zone blades, for example, from a control computer, a plate scanner or a separate computer. Furthermore, the production run ink profile can be established more quickly in accordance with German reference DE 196 15 156 A1. Using this method, a filling process is carried out in the gaps between the ink zone blades and the ink duct roller 10, whereby a dosing device is brought, over the entire breadth of the inking mechanism, into a position bordering a filling gap. The dosing devices are briefly moved into a transition setting with a greater deviation from the final filling gap position than exists for the production run ink profile. Afterward, the dosing devices are moved into a setting corresponding to the production run ink profile.

It is advantageous during the filling process, for example, for the filling gap to be enlarged, continuously or in several steps, to a final gap width of over 50%, preferably 60% to 70%, of the maximum gap width. In another advantageous embodiment the dosing devices, especially those in outer zones, are opened almost completely, preferably to 90% to 100% of the maximum gap width, at the beginning of the filling process. Then, when the other dosing devices reach the final filling gap width, the aforementioned outer zone dosing devices are moved back toward this. In this way, an ink deficit in the outer regions is avoided.

When the ink application rollers 19–22 are positioned on the form cylinder 6 at the third timepoint $t_3$, the desired ink layer thickness is attained on the form cylinder 6 within an extremely short time. For example, no more than 100 printed copies that must be considered spoilage are produced on the printing stock web. The copies printed thereafter satisfy the target requirements.

Starting at the third timepoint $t_3$, the values of the ink zone blade gap are readjusted. While a folding and cutting register in the folding mechanism of the printing machine 1 is adjusted, ink registers of several of the printing units are brought into agreement with each other. As soon as the process ends, i.e., at a fourth timepoint $t_4$ at the latest, the printing machine 1 is again accelerated, until attaining, for example, a fifth number of revolutions $U_5$ at a fifth timepoint $t_5$. Subsequently, the ink zone blade gap, the ink register of the form cylinders, and the folding and cutting register in the folding mechanism are again adjusted. Then, starting at a sixth timepoint $t_6$, the printing machine 1 is again accelerated until, at a seventh timepoint $t_7$, the target number of revolutions $U_s$ for production run printing is attained.

When a print job is to be ended or when a quick stop occurs due to a malfunction (e.g., faulty adhesion, web tear, activation of web break safety alarm without a web tear having occurred, or a malfunction of folding mechanism), the printing machine 1 must again be brought to a standstill. For this purpose, first the transfer cylinders 26, 26' and, together therewith, the form cylinders 6, 6', are moved away from the printing stock web 2. At almost the same time, the ink application rollers 20–22 are moved away from the form cylinder 6, while simultaneously the ink application rollers 20'–22' are moved away from the corresponding form cylinder 6'. Ink application rollers 19, 19' are then moved away from form cylinders 6, 6' at a ninth timepoint $t_9$.

At an eighth timepoint $t_8$, the feed rollers 11, 11' are already moved away from the ink duct rollers 10, 10', so that no further of the printing ink is transferred to the inking mechanism 7 and 7', and the printing ink remaining therein is used up. At the same time, the drier is set to maximum power. At the ninth timepoint $t_9$, the drier attains a highest performance level, so as to eliminate high solvent concentrations in air flow during subsequent cleaning processes. The printing machine 1 is then slowed to the second number of revolutions $U_2$. It is a prerequisite that the speed of the printing machine 1 does not fall below the second number of revolutions $U_2$. Simultaneously, the rubber blankets of the transfer cylinders 26, 26' are washed. Washing of the inking mechanisms 7, 7' begins concurrent with the washing of the transfer cylinders 26, 26'. The cleaning agent is sprayed from the spray bars 27, 28, 27', 28' onto the inking mechanism rollers 11–22, 11'–22', and then wiped by means of the blades 29, 29'.

The rubber blankets of the transfer cylinders 26, 26' continue to be washed at the second rotational speed $U_2$ until the transfer cylinders 26, 26' are clean. The printing machine 1 is shut down at a tenth timepoint $t_{10}$ or, if cleaning the transfer cylinders 26, 26' requires a longer time, at an eleventh timepoint $t_{11}$.

When the rubber blankets are clean, the cleaning of the inking mechanisms 7, 7' has ended, although the cleaning of the inking mechanisms 7, 7' may require a longer time than the cleaning of the rubber blanket. As soon as the inking mechanisms 7, 7' are clean, they again achieve the defined starting state, which permits the printing machine 1 to be set in motion in the same manner as described above. This is true regardless of whether the production of a certain printing subject has ended or, on the other hand, the interruption in printing was simply due to a technical malfunction.

Preferably, a wetting blade is provided at the wetting agent duct roller 24. The wetting blade is positioned on the wetting agent duct roller 24 when the wetting mechanism 8 is to be cleaned. The wetting mechanism 8 is therefore cleanable while the inking mechanism 7 is being cleaned. The wetting distributor 25 is then moved away from the ink application roller 19.

Alternatively, the present invention is usable when, instead of the feed rollers 11, 11', there are film rollers that are moved away from the ink duct rollers 10, 10'.

Furthermore, the present invention is applicable for the printing unit 3 having only a single printing group 4, in which the transfer cylinder 26 interacts with a pressure cylinder that takes the place of the transfer cylinder 26'. The pressure cylinder, is movable away from the printing stock web 2.

Additionally, the present invention is suitable when the printing web 2 is printed directly by the form cylinder 6 and the form cylinder 6 is movable away from the printing web 2. In this embodiment, all inking mechanism rollers 11–22 are supplied with the printing ink during the pre-inking process while the ink application rollers 19–22 are moved away from the form cylinder 6. Alternatively, the ink application rollers 19–22 are positioned on the form cylinder 6 during the pre-inking process, however, the form cylinder 6 is moved away from the printing web 2 so that the form cylinder 6 is inked with printing ink as well. Thereby, all rollers of the inking mechanism and, if there is one, the wetting mechanism, carry out, together with the form cylinder 6, the positioning movement onto the printing stock web 2.

A special advantage of the present invention is that the inking mechanism 7 or both inking mechanisms 7, 7', are cleaned and prepared for another production run, while all of the inking mechanism rollers 11–22 are inked with the printing ink. At the same time, the form cylinder 6 and the transfer cylinder 26 (if there is one) are stationary allowing the printing web 2 to be inserted into the printing machine 1. The present invention is thus especially suitable for unplanned stops during the production run process.

In yet another embodiment, the ink application rollers 19–22 are positioned on the form cylinder 6 during the pre-inking while the form cylinder 6 is moved away from the transfer cylinder 26. The form cylinder 6 and the inking mechanism 7 are therefore driven separately from the transfer cylinder 26 and the pressure cylinder, if there is one. For this purpose, the form cylinder 6 and the driven inking mechanism rollers 14, 17, 18 either have individual drives or a shared driving unit. Alternatively the form cylinder 6 and the inking mechanism rollers 14, 17, 18 have drives which are separated by couplings during the inking process from the drives of the transfer cylinder 26 and the pressure cylinder, if there is one. By means of synchronization devices for speed and, especially, rotational angle, the drives for the inking mechanism 7, the form cylinder 6, the rubber-blanket cylinder 26 and the pressure cylinder are reconnected as soon as the form cylinder 6 has been inked by the inking mechanism 7 to an extent suitable for the production run.

Advantageously, the transfer cylinder 26 and the pressure cylinder have a drive not connected to the form cylinder 6 and the inking mechanism 7, so that the transfer cylinder 26 and the printing web 2 are rotatable at a speed clearly lower than the speed the form cylinder 6. The transfer cylinder 26 and the printing web 2 may even be stopped, as long as the transfer cylinder 26 is not in contact with the form cylinder 6. Next, the transfer cylinder 26 and the printing web 2 are accelerated until they are synchronous with the circumferential speed of the form cylinder 6. The form cylinder 6 and the transfer cylinder 26 are positioned for the purpose of printing the printing web 2, i.e., at the third timepoint $t_3$. At the third timepoint $t_3$, an optimized equilibrium between the printing ink and the wetting agent exists on the surface of the form cylinder 6.

The present invention is applicable when no wetting mechanism is provided, i.e., for dry offset printing or for direct printing with no wetting agent. The present invention is also suitable for other printing methods, for example, gravure or relief printing, and especially indirect gravure printing, when instead of the transfer cylinder 26, a transfer cylinder adapted for gravure printing is provided. Furthermore, the present invention is used for direct printing, i.e., when no transfer cylinder 26 is present. In the case of direct printing, if the form cylinder 6 is to be inked before the beginning of the printing process, sufficient distance between the form cylinder 6 and the printing web 2 must be ensured. Therefore, none of the printing ink travels from the form cylinder 6 to the web 2 during the pre-inking, as long as the printing stock web 2 is standing still or moving at reduced speed in relation to the form cylinder 6. The ink transfer rollers 19–22 are positioned on the form cylinder 6 until the ink layer thickness required for a production run is attained on all of the inking mechanism rollers 11–22. The same holds true when the form cylinder 6 is included in the inking process, i.e., when the ink application rollers 19–22 are positioned on the form cylinder 6 during start-up, while the form cylinder 6 is moved away from the transfer cylinder 26. In the case of an indirect printing process with no transfer cylinder, the form cylinder 6 is moved away from the printing web 2.

Figure 3A:
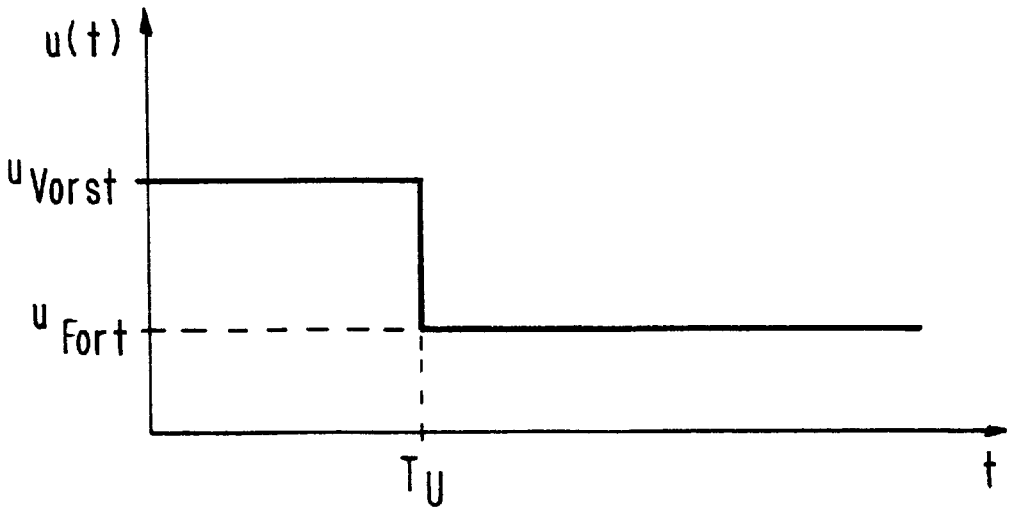
FIGS. 3*a,b* are graphs showing ink zone setting and layer thickness curves in the inking mechanism, with servocontrol, as a function of time.

In another embodiment, the printing machine 1 has a servocontrol so as to control the inking mechanisms, i.e., the inking mechanisms 7, 7', in particular. A vector $u_{Vorst}$, of a setting variable during the servocontrol, relates to a servocontrol increase (or reduction) of the gap width of each ink zone blade, which corresponds to the ink density per zone of a subject to be printed. The vector $u_{vorst}$ is a function of a stationary final value of the ink layer thickness $S_{Fort}$ for a production run, a constant time $t_S$ specific to length of the inking mechanism 7, 7', a selected changeover timepoint $T_U$, a machine-dependent factor k dependent upon total surface of the inking mechanism 7, 7' and an oscillating characteristic of the ink distributors 14, 17, 18. As FIG. 3*a* shows, during start-up the ink zones have a gap opening $u_{Vorst}$ much greater than the gap opening $u_{Fort}$ needed for the production run. The greater gap opening $u_{Vorst}$ is maintained up to the changeover timepoint $T_U$. The following relationship exists between the vector of the setting variable during the servo-control $u_{Vorst}$ and the stationary ink layer thickness $s_{Fort}$:

$$u_{Vorst}=S_{Fort}k_s^{-}(1-exp(-T_U/T_S))^{-1}$$

This relationship is known, for example, from a research report "Multi-Zonal Inking Mechanism Control" [Mehrzonale Farbwerkssteuerung] by B. Hentschel, K. Seyfahrth and W. Preissler, TU Chemnitz, 1992.

Figure 3B:
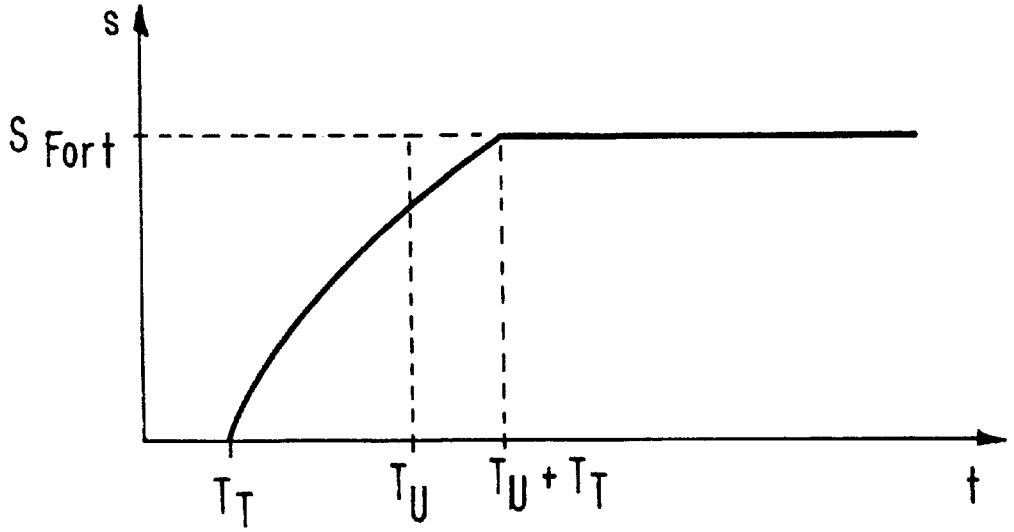

The inking zone blades are opened at timepoint T=0, whereby after a certain delay, a dead time $T_T$, a build-up of the ink layer thickness s (FIG. 3*b*) on the inking mechanism rollers 11 to 22 begins. The ink zone blades resting on the ink duct roller 10 are opened in accordance with the required gap widths. The dead time $T_T$ occurs until an ink profile s (FIG. 3*b*) begins to build up on the ink application rollers 19–22. The dead time $T_T$ is considered when the ink zone blades are set at a timepoint $T_U$ to the gap width $U_{Fort}$ required for the production run printing. The ink thickness profile $S_{Fort}$ needed for the production ran thus is available after a time period $T_U+T_T$. This time period is therefore taken into account when the inking mechanism is activated at the timepoint $t_F$ (FIG. 2), so that the ink application rollers 19–22 are positioned on the form cylinder 6 when the form cylinder 6 attains the first number of revolutions $U_1$, i.e., between the second and third timepoints $t_2$, $t_3$.

In the case of printing methods that use a wetting agent, to ensure that the surface of the form cylinder 6 is adequately moistened even at the beginning of inking, the following procedure must be followed: First, the wetting distributors 25 and the ink application roller 19, which is moved away from the form cylinder 6, are brought into contact with each other. Next, the ink application roller 19 is brought into contact with the form cylinder 6 so as to moisten the form cylinder 6. Only then are the other ink application rollers 20, 22 positioned on the form cylinder 6 so as to ink the form cylinder 6.

The present invention advantageously provides a process for pre-inking an inking mechanism 7, 7', which is cleaned when all other rotating parts of the printing machine 1 are standing still, in particular, even with an inserted printing web 2. By means of a washing device 27–30, 27'–30', ink residues are removed from the inking mechanism 7, 7' until a defined starting state is reached. The inking mechanism 7, 7' is then newly inked in keeping with subject-specific instructions, i.e., in keeping with a print job to be printed, in parallel fashion during the start-up of the printing machine 1. The ink application rollers 19–20 are positioned on the form cylinder 6 when the form cylinder 6 has reached the required minimum number of revolutions.

The invention is not limited by the embodiments described above which are presented as examples only but can be modified in various ways within the scope of protection defined by the appended patent claims.

What is claimed:

1. A process for attaining a production-run state for printing an image on a printing web, in a web-fed rotary printing machine with a form cylinder and an inking mechanism having ink zones, the inking mechanism including an ink duct box, an ink duct roller, and a plurality of ink transfer rollers and a plurality of ink application rollers arranged so as to ink the form cylinder by zones in accordance with the image to be printed, comprising the steps of:

(a) driving the ink duct roller, the plurality of the ink transfer rollers and the plurality of the ink application rollers independently of the form cylinder;

(b) inking the ink duct roller, the plurality of the ink transfer rollers and the plurality of the ink application rollers with printing ink in accordance with the image to be printed one of parallel to and independent of a start-up process of the form cylinder and the printing web; and (c) positioning the plurality of ink application rollers on the form cylinder when the form cylinder has reached a predetermined speed.

2. The process according to claim 1, wherein the rotary printing machine includes a wetting mechanism having a wetting agent application roller, the process further comprising the steps of:

(d) moistening the form cylinder by means of the wetting mechanism; and (e) positioning the wetting agent application roller on the form cylinder prior to the step of positioning the plurality of ink application rollers on the form cylinder.

3. A process for attaining a production-run state for printing an image on a printing web, in a web-fed rotary printing machine with a form cylinder and an inking mechanism having ink zones, the inking mechanism including an ink duct box, an ink duct roller, and a plurality of ink transfer rollers and a plurality of ink application rollers arranged so as to ink the form cylinders by zones in accordance with the image to be printed, comprising the steps of:

(a) driving the ink duct roller, the plurality of the ink transfer rollers, the plurality of the ink application rollers and the form cylinder, independently of the printing web;

(b) inking the form cylinder by means of the inking mechanism during a start-up of the printing, machine; and (c) positioning the form cylinder on the printing web in dependence upon a circumferential speed of the form cylinder agreeing with a predetermined web speed of the printing web.

4. The process according to claim 3, wherein the rotary printing machine includes a wetting mechanism, further comprising the step of:

(d) moistening the form cylinder by means of the wetting mechanism, by first moistening an outer circumferential surface of the form cylinder with one of the ink application rollers, prior to opening an ink gap on the ink duct roller.

5. The process according to claim 1, wherein the rotary printing machine includes a transfer cylinder connected between the form cylinder and the printing web, further comprising the steps of:

(d) moving the transfer cylinder together with the printing web; and (e) positioning the form cylinder on the transfer cylinder in dependence upon a circumferential speed of the form cylinder agreeing with a circumferential speed of the transfer cylinder.

6. The process according to claim 5, wherein one of the plurality of ink application rollers simultaneously serves as a wetting agent application roller.

7. The process according to claim 1, wherein some of the ink transfer rollers and ink application rollers are combined in an ink distributor, the driving step including one of individually driving the ink distributor and the ink duct roller, jointly driving the ink distributor and the ink duct roller independent of the form cylinder and the transfer cylinders, and synchronously driving the ink distributor and the ink duct roller in a state disconnected from the driving of the form cylinder and the transfer cylinders and linking together the driving when synchronization with the form cylinder and the transfer cylinder is achieved.

8. The process according to claim 1, wherein the inking step includes adjusting ink quantity supplied to the ink duct roller during a pre-inking process in dependence upon parameters related to ink zone and time.

9. A process for washing an inking mechanism in a rotary printing machine having a form cylinder and an inking mechanism having ink zones, the inking mechanism including an ink duct box, an ink duct roller, and a plurality of ink transfer rollers and a plurality of ink application rollers arranged so as to ink the form cylinder by zones in accordance with the image to be printed, the rotary printing machine being pre-inked by driving the ink duct roller, the plurality of the ink transfer rollers and the plurality of the ink application rollers independently of the form cylinder, inking the ink duct roller, the plurality of the ink transfer rollers and the plurality of the ink application rollers, in accordance with the image to be printed with printing ink at least one of parallel to and independent of a start-up process of the form cylinder and the printing web, and positioning the plurality of ink application rollers on the form cylinder when the form cylinder has reached a predetermined speed, the washing process comprising the steps of:

moving the ink application rollers away from the form cylinders during a deceleration of the web-fed rotary printing machine;

driving the ink application rollers independently of the form cylinder; and washing the ink application rollers with a cleaning, device.

10. The process according to claim 9, wherein the rotary printing machine includes at least one of a film roller and a feed roller, further comprising the step of moving at least one of the film roller and the feed roller away from the ink duct roller prior to the washing process.

11. The process according to claim 10, further comprising the step of moving at least one of the film roller and the feed roller away from the ink roller prior to the ink application rollers being moved away from the form cylinder.

12. The process according to claim 3, wherein the rotary printing machine includes a transfer cylinder connected between the form cylinder and the printing web, further comprising the steps of:

moving the transfer cylinder together with the printing web; and positioning the form cylinder on the transfer cylinder in dependence upon a circumferential speed of the form cylinder agreeing with a circumferential speed of the transfer cylinder.

13. The process according to claim 12, wherein one of the plurality of ink application rollers simultaneously serves as a wetting agent application roller.

14. The process according to claim 3, wherein some of the ink transfer rollers and ink application rollers are combined in an ink distributor, the driving step including one of individually driving the ink distributor and the ink duct roller, jointly driving the ink distributor and the ink duct roller independent of the form cylinder and the transfer cylinders, and synchronously driving the ink distributor and the ink duct roller in a state disconnected from the driving of the form cylinder and the transfer cylinder and linking together the driving when synchronization with the form cylinder and the transfer cylinder is achieved.

15. The process according to claim 3, wherein the inking step includes adjusting the ink quantity supplied to the ink duct roller during a pre-inking process in dependence upon parameters related to ink zone and time.

* * * * *